US008148306B2

(12) United States Patent
Bartley et al.

(10) Patent No.: US 8,148,306 B2
(45) Date of Patent: Apr. 3, 2012

(54) PRODUCT OF AMINES WITH HYDROXY ACID AS FRICTION MODIFIERS SUITABLE FOR AUTOMATIC TRANSMISSION FLUIDS

(75) Inventors: Stuart L. Bartley, Lakewood, OH (US); Shreyasi Lahiri, Mentor, OH (US); Mark R. Baker, Lyndhurst, OH (US); Craig D. Tipton, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 557 days.

(21) Appl. No.: 12/089,637

(22) PCT Filed: Oct. 11, 2006

(86) PCT No.: PCT/US2006/039768

§ 371 (c)(1),
(2), (4) Date: Jul. 24, 2009

(87) PCT Pub. No.: WO2007/044820

PCT Pub. Date: Apr. 19, 2007

(65) Prior Publication Data

US 2009/0312207 A1 Dec. 17, 2009

Related U.S. Application Data

(60) Provisional application No. 60/725,360, filed on Oct. 11, 2005.

(51) Int. Cl.
*C10M 141/10* (2006.01)
*C10M 159/20* (2006.01)
*C10M 135/18* (2006.01)

(52) U.S. Cl. ..... 508/161; 508/356; 508/363

(58) Field of Classification Search ..... 508/161, 508/335, 356, 363

See application file for complete search history.

(56) References Cited

U.S. PATENT DOCUMENTS

| | | | | |
|---|---|---|---|---|
| 4,000,159 | A | 12/1976 | Scoggins et al. | |
| 4,512,903 | A | 4/1985 | Schlicht et al. | |
| 4,525,288 | A * | 6/1985 | Schlicht | 508/555 |
| 4,647,389 | A | 3/1987 | Karol et al. | |
| 4,741,848 | A | 5/1988 | Koch et al. | |
| 4,886,612 | A | 12/1989 | Higaki et al. | |
| 5,620,948 | A | 4/1997 | Tipton | |
| 5,750,476 | A | 5/1998 | Nibert et al. | |
| 5,858,929 | A * | 1/1999 | Sumiejski et al. | 508/162 |
| 6,008,169 | A | 12/1999 | Kaneko | |
| 6,232,275 | B1 | 5/2001 | Ichihashi et al. | |
| 6,312,481 | B1 | 11/2001 | Lin et al. | |
| 6,436,882 | B1 * | 8/2002 | Rizvi | 508/390 |
| 6,793,696 | B2 | 9/2004 | Krull et al. | |
| 2005/0148476 | A1 | 7/2005 | Tipton et al. | |

FOREIGN PATENT DOCUMENTS

WO 2004007652 A1 1/2004

OTHER PUBLICATIONS

Written Opinion from corresponding PCT Publication WO 2007/044820; completed Mar. 12, 2007.
Search Report from corresponding international application No. PCT/US2006/039768 filed Oct. 11, 2006.

* cited by examiner

*Primary Examiner* — Walter D Griffin
*Assistant Examiner* — Francis C Campanell
(74) *Attorney, Agent, or Firm* — David M. Shold; Christopher D. Hilker

(57) ABSTRACT

Compositions comprising an oil of lubricating viscosity; an amide represented by the formula $R^1R^2N—C(O)R^3$ wherein $R^1$ and $R^2$ are hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent; a nitrogen-containing dispersant; and a phosphorus-containing compound are suitable for lubricating a transmission.

15 Claims, No Drawings

PRODUCT OF AMINES WITH HYDROXY ACID AS FRICTION MODIFIERS SUITABLE FOR AUTOMATIC TRANSMISSION FLUIDS

This application claims priority from U.S. Provisional Application 60/725,360, filed Oct. 11, 2005.

BACKGROUND OF THE INVENTION

The present invention relates to the field of additives for fluids such as automatic transmission fluids, traction fluids, fluids for continuously variable transmission fluids (CVTs), dual clutch automatic transmission fluids, farm tractor fluids, and engine lubricants.

In the automatic transmission marketplace, where there is rapid engineering change driven by the desire to reduce weight and increase transmission capacity, there is a desire for automatic transmission fluids that exhibit a high static coefficient of friction for improved clutch holding capacity. At the same time, there is a desire to improve the retention of positive slope characteristics in the μ/v (coefficient of friction vs. sliding speed) curve. There are newer tests in the marketplace which are used to define these characteristics. The static torque can be measured in tests such as the Toyota SAE#2 friction test procedure and the retention of positive slope can be measured by procedures like the JASO LVFA (Japan Automotive Standards Organization, Low Velocity Friction Apparatus) in which the slope of the μ/v curve is periodically measured during oxidative and mechanical aging.

There are patents, for example, U.S. Pat. No. 5,750,476, where a type of friction modifier technology used to achieve this performance is described. The combined requirements of high static coefficient of friction and durable positive slope are often incompatible with traditional ATF friction modifier technology which is extremely well described in the patent literature. Many of the commonly used friction modifiers result in a low static coefficient of friction and are not durable enough on positive slope to be of sufficient use. Additional patent literature describing technology for retaining positive mu/v or anti-shudder characteristics include U.S. Pat. No. 5,858,929. These may employ metal detergents and combinations of friction modifiers.

U.S. Pat. No. 4,512,903, Schlicht et al., Apr. 23, 1985, discloses amides prepared from mono- or poly hydroxy-substituted aliphatic monocarboxylic acids and primary or secondary amines, useful as friction reducing agents.

PCT Publication WO04/007652, Adams et al, Jan. 22, 2004, discloses a fluid composition of (a) a friction modifier derived from the reaction of a carboxylic acid with an amino alcohol, the friction modifier containing at least two hydrocarbyl groups, and (b) a dispersant, which provides good friction properties in an automatic transmission.

U.S. Pat. No. 4,886,612 discloses a lubricating oil comprising at least one of various products, which can be various imidazolines or an oxazoline of the structure

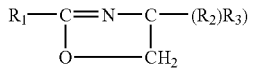

where $R_2$ and $R_3$ each represent $CH_2OCOR_1$, $CH_2OH$ or H, prepared by the condensation a carboxylic acid (or a reactive equivalent thereof) with an amino alcohol; for example, the condensation of two moles of isostearic acid with one mole of tris-hydroxymethylaminomethane (THAM).

The present invention solves the problem of developing new and relatively simple and inexpensive friction modifiers to obtain high static coefficients of friction and maintain a durable positive slope during oxidative and mechanical stressing of the friction system for use in a mechanical device such as an automatic transmission. Moreover, the formulations of the present invention exhibit good anti-shudder durability and friction stability in automatic transmission testing, in combination with good oxidative stability and low copper corrosion. This is accomplished at least in part by the use of a friction modifier which comprises the condensation product of a secondary amine having two alkyl groups of at least 6 carbon atoms, with a hydroxyacid or hydroxythioacid, in combination with other components, as further described in detail below. The compositions are useful, among other applications, for lubricating a transmission such as an automatic transmission, including different varieties of transmissions such as traction drives, continuously variable transmissions, dual clutch transmissions, and hybrid manual-automatic transmissions, as well as transmissions for hybrid gasoline/electric vehicles.

SUMMARY OF THE INVENTION

The present invention provides a composition suitable for lubricating a mechanical device, comprising:

(a) a major amount of oil of lubricating viscosity;

(b) an amide or thioamide represented by the formula $$R^1R^2N—C(X)R^3$$

wherein X is O or S, $R^1$ and $R^2$ are each independently hydrocarbyl groups of at least 6 carbon atoms, and $R^3$ is a hydroxyalkyl group of 1 to 6 carbon atoms or a group formed by the condensation of said hydroxyalkyl group, through a hydroxyl group thereof, with an acylating agent;

(c) a nitrogen-containing dispersant; and (d) a phosphorus-containing compound, provided that the composition contains less than 0.1 percent by weight of a zinc dialkyldithiophosphate.

The present invention further provides a method for lubricating a transmission, comprising supplying thereto the above composition.

The present invention further provides a concentrate suitable for dilution with oil of lubricating viscosity to prepare a lubricant for a mechanical device, comprising (a) a concentrate-forming amount of an oil of lubricating viscosity; and (b) an amide or thioamide represented by the formula $$R^1R^2N—C(X)R^3$$

wherein X is O or S, $R^1$ and $R^2$ are each independently hydrocarbyl groups of at least 6 carbon atoms, and $R^3$ is a hydroxyalkyl group of 1 to 6 carbon atoms or a group formed by the condensation of said hydroxyalkyl group, through a hydroxyl group thereof, with an acylating agent; a nitrogen-containing dispersant; and a phosphorus-containing compound, provided that the concentrate contains less than 1 percent by weight of a zinc dialkyldithiophosphate.

DETAILED DESCRIPTION OF THE INVENTION

Various preferred features and embodiments will be described below by way of non-limiting illustration.

One component of the present invention is oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

Natural oils useful in making the inventive lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and inter-polymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans.

Unrefined, refined and rerefined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is an API Group II, Group III, Group IV, or Group V oil, including a synthetic oil, or mixtures thereof. These are classifications established by the API Base Oil Interchangeability Guidelines. Both Group II and Group III oils contain <0.03 percent sulfur and >99 percent saturates. Group II oils have a viscosity index of 80 to 120, and Group III oils have a viscosity index >120. Polyalphaolefins are categorized as Group IV. The oil can also be an oil derived from hydroisomerization of wax such as slack wax or a Fischer-Tropsch synthesized wax. Group V is encompasses "all others" (except for Group I, which contains >0.03% S and/or <90% saturates and has a viscosity index of 80 to 120).

The oil of lubricating viscosity may also comprise a mixture of different types of oils. In one embodiment, at least 50% by weight of the oil of lubricating viscosity is a polyalphaolefin (PAO). Typically, the polyalphaolefins are derived from monomers having from 4 to 30, or from 4 to 20, or from 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present invention can encompass oils of a single viscosity range or a mixture of high viscosity and low viscosity range oils. It may also comprise a mixture of different types of oils. In a preferred embodiment, the oil exhibits a 100° C. kinematic viscosity of 1 or 2 to 8 or 10 $mm^2/sec$ (cSt). The overall lubricant composition may be formulated using oil and other components such that the viscosity at 100° C. is 1 or 1.5 to 10 or 15 or 20 $mm^2/sec$ and the Brookfield viscosity (ASTM-D-2983) at −40° C. is less than 20 or 15 Pa-s (20,000 cP or 15,000 cP), preferably less than 10 Pa-s, even 5 or less.

Component (b) is an amide or thioamide (at least one amide or thioamide), which can be viewed as the condensation product of a secondary amine with a hydroxy acid or thioacid (described below), which can serve as a friction modifier. The amine will contain substituent hydrocarbyl groups, for example, alkyl groups. The amine may be represented by the formula $$R^1R^2NH$$

wherein $R^1$ and $R^2$ are each independently a hydrocarbyl group of at least 6 carbon atoms (e.g., 6 to 30 carbon atoms or 8 to 24 carbon atoms or 10 to 20 or 10 to 18 or 12 to 16). The $R^1$ and $R^2$ groups may be linear or branched, saturated or unsaturated, aliphatic, aromatic, or mixed aliphatic and aromatic. In certain embodiments they are alkyl groups and in particular linear alkyl groups. The $R^1$ and $R^2$ groups may be the same or different. A commercial example of a suitable amine is sold under the trade name Armeen 2C™, which is believed to have two $C_{12}$ alkyl groups. In one embodiment the amine comprises di-cocoalkyl amine or homologous amines. Di-cocoalkyl amine (or di-cocoamine) is a secondary amine in which the two R groups in the above formula are predominantly $C_{12}$ groups (although amounts of C8 through C18 are generally also present), derived from coconut oil. In certain embodiments, one both of the groups $R^1$ and $R^2$ may be 2-ethylhexyl groups. In one embodiment, the amine moiety $R^1R^2N$— of the amide or thioamide comprises a (2-ethylhexyl)(hydrogenated tallow) amine moiety, where the "hydrogenated tallow" moiety is derived from tallow, having predominantly $C_{18}$ groups. It is understood that commercially available dialkylamines will contain certain amounts of monoalkylamines and/or trialkylamines, and products formed from such commercial materials are contemplated to be within the scope of the present inventions (recognizing that any trialkylamine component would not be expected to be reactive to form an amide.)

The amide or thioamide of the present invention is the condensation product of the above-described amine with a hydroxy acid or hydroxy thioacid or reactive equivalent thereof. In the instance where X is O, the amide is a derivative of a hydroxy acid which can be represented by the formula $R^3COOH$. In the hydroxy acid (or hydroxy thioacid, as the case may be) $R^3$ is a hydroxyalkyl group of 1 to 6 carbon atoms or a group formed by the condensation of such hydroxyalkyl group, through the hydroxyl group thereof, with an acylating agent (which may include a sulfur-containing acylating agent). That is, the —OH group on $R^3$ is itself potentially reactive and may condense with additional acidic materials or their reactive equivalents to form, e.g., esters. Thus, the hydroxy acid may be condensed, for instance, with one or more additional molecules of acid such as glycolic acid. An example of a suitable hydroxy acid is glycolic acid, that is, hydroxyacetic acid, HO—$CH_2$—COOH. Glycolic acid is readily commercially available, either in substantially neat form or as a 70% solution in water. When $R^3$ contains more than 1 carbon atom, the hydroxy group may be on the 1 carbon (α) or on another carbon in the chain (e.g., β or ω). The carbon chain itself may be linear, branched or cyclic.

The amount of component (b) in the compositions of the present invention is generally an amount suitable to reduce or inhibit shudder in an automatic transmission, that is, a performance defect observed during shifting when the friction characteristics of the transmission fluid are inadequately balanced. The effective amount can be 0.05 to 10.0 percent by weight of the finished fluid formulation. Alternative amounts include 0.07 percent to 5 percent, or 0.1 percent to 3 percent, or 0.1 to 2 percent, or 0.5 to 1.5 percent or 0.2 to 5 percent or 0.5 to 5 percent by weight. In a concentrate, the amounts will be proportionately higher.

Component (c) is a nitrogen-containing dispersant (at least one nitrogen-containing dispersant). It may be described as "other than a species of (b)," in the event that some of the friction modifiers of (b) may exhibit some dispersant characteristics. Examples of nitrogen-containing dispersants are described in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. No. 6,165,235.

Succinimide dispersants, a species of nitrogen-containing dispersants, are prepared by the reaction of a hydrocarbyl-substituted succinic anhydride (or reactive equivalent thereof, such as an acid, acid halide, or ester) with an amine, as described above. The hydrocarbyl substituent group generally contains an average of at least 8, or 20, or 30, or 35 up to 350, or to 200, or to 100 carbon atoms. In one embodiment, the hydrocarbyl group is derived from a polyalkene. Such a polyalkene can be characterized by an $\overline{M}_n$ (number average molecular weight) of at least 500. Generally, the polyalkene is characterized by an $\overline{M}_n$ of 500, or 700, or 800, or 900 up to 5000, or to 2500, or to 2000, or to 1500. In another embodiment $\overline{M}_n$ varies from 500, or 700, or 800, to 1200 or 1300. In one embodiment the polydispersity ($\overline{M}_w/\overline{M}_n$) is at least 1.5.

The polyalkenes include homopolymers and inter-polymers of polymerizable olefin monomers of 2 to 16 or to 6, or to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the inter-polymer is a homo-polymer. An example of a polymer is a polybutene. In one instance about 50% of the polybutene is derived from isobutylene. The polyalkenes can be prepared by conventional procedures.

In one embodiment, the succinic acylating agents are prepared by reacting a polyalkene with an excess of maleic anhydride to provide substituted succinic acylating agents wherein the number of succinic groups for each equivalent weight of substituent group is at least 1.3, e.g., 1.5, or 1.7, or 1.8. The maximum number of succinic groups per substituent group generally will not exceed 4.5, or 2.5, or 2.1, or 2.0. The preparation and use of substituted succinic acylating agents wherein the substituent is derived from such polyolefins are described in U.S. Pat. No. 4,234,435.

The substituted succinic acylating agent may be prepared by the so-called "chlorine" route or by the so-called "thermal" or "direct alkylation" routes. These routes are described in detail in published application US 2005-0202981, paragraphs 0014 through 0017. A direct alkylation or low-chlorine route is also described in U.S. Pat. No. 6,077,909, refer to column 6 line 13 through col. 7 line 62 and column 9 lines 10 through col. 10 line 11. Illustrative thermal or direct alkylation processes involve heating a polyolefin, typically at 180 to 250° C., with maleic anhydride under an inert atmosphere. Either reactant may be in excess. If the maleic anhydride is present in excess, the excess may be removed after reaction by distillation. These reactions may employ, as the polyolefin, high vinylidene polyisobutylene, that is, having >75% terminal vinylidene groups (α and β isomers).

The substituted succinic acylating agent is typically reacted with an amine, including those amines described above, to form the succinimide dispersant. More generally, the amine may be a mono- or polyamine. Monoamines generally have at least one hydrocarbyl group containing 1 to 24 carbon atoms, or 1 to 12 carbon atoms. Examples of monoamines include fatty (C8-30) amines, primary ether amines, tertiary-aliphatic primary amines, hydroxyamines (primary, secondary or tertiary alkanol amines), ether amines, N-(hydroxyhydrocarbyl) amines, and hydroxyhydrocarbyl. Polyamines include alkoxylated diamines, fatty diamines, alkylenepolyamines (ethylenepolyamines such as diethylenetriamine, triethylenetetramine, tetraethylenepentamine), hydroxy-containing polyamines, polyoxyalkylene polyamines, condensed polyamines (a condensation reaction between at least one hydroxy compound with at least one polyamine reactant containing at least one primary or secondary amino group), and heterocyclic polyamines. Also included are heavy amine products known as amine still bottoms. Useful amines include those disclosed in U.S. Pat. No. 4,234,435 (Meinhart) and U.S. Pat. No. 5,230,714 (Steckel).

The amount of amine reacted with the acylating agent to form the dispersant is typically an amount to provide a mole ratio of CO:N of 1:2 to 1:0.75. If the amine is a primary amine, complete condensation to the imide can occur. Varying amounts of amide product, such as the amidic acid, may also be present. If the reaction is, rather, with an alcohol, the resulting dispersant will be an ester dispersant. If both amine and alcohol functionality are present, whether in separate molecules or in the same molecule (as in the above-described condensed amines), mixtures of amide, ester, and possibly imide functionality can be present. These are the so-called ester-amide dispersants.

"Amine dispersants" are reaction products of relatively high molecular weight aliphatic or alicyclic halides and amines, such as polyalkylene polyamines. Examples thereof are described in the following U.S. patents: U.S. Pat. Nos. 3,275,554, 3,438,757, 3,454,555, and 3,565,804.

"Mannich dispersants" are the reaction products of alkyl phenols in which the alkyl group typically contains at least 30 carbon atoms with aldehydes (especially formaldehyde) and amines (especially polyalkylene polyamines). The materials described in the following U.S. patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

Post-treated dispersants are also part of the present invention. They are generally obtained by reacting a succinimide, amine or Mannich dispersant with reagents such as urea, thiourea, carbon disulfide, aldehydes, ketones, carboxylic acids (such as terephthalic acid) or anhydrides (such as maleic anhydride), hydrocarbon-substituted succinic anhydrides, nitriles, epoxides, boron compounds such as boric acid (to give boron-containing dispersants or "borated dispersants"), phosphorus compounds (in particular, an inorganic phosphorus acid or a metal or amine salt thereof, e.g., phosphorus acids or anhydrides such as phosphoric acid or phosphorous acid), or 2,5-dimercaptothiadiazole (DMTD). Exemplary materials of this kind are described in the following U.S. patents: U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

Mixtures of dispersants can also be used. The amount of component (c) in the compositions of the present invention is generally 0.3 to 10 percent by weight. In other embodiments, the amount of component (c) is 0.5 to 7 percent or 1 to 5 percent of the final blended fluid formulation. In a concentrate, the amounts will be proportionately higher.

Another component of the present invention is a (at least one) phosphorus-containing compound, organic or inorganic.

This can be a phosphorus acid, phosphorus acid salt, phosphorus acid ester or derivative thereof including sulfur-containing analogs. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus compound can be an organic or inorganic phosphorus acid, phosphorus acid ester, phosphorus acid salt, or derivative thereof. Phosphorus acids include the phosphoric, phosphonic, phosphinic, and thiophosphoric acids including dithiophosphoric acid as well as the monothiophosphoric, thiophosphinic and thiophosphonic acids. Any of these phosphorus-containing compounds may also be in the form of a metal salt or an amine salt. One group of phosphorus compounds are alkylphosphoric acid mono alkyl primary amine salts as represented by the formula

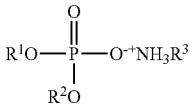

where $R^1$, $R^2$, $R^3$ are alkyl or hydrocarbyl groups or one of $R^1$ and $R^2$ can be H. The materials can be a 1:1 mixture of dialkyl and monoalkyl phosphoric acid esters or salts thereof. Compounds of this type are described in U.S. Pat. No. 5,354,484.

Organic phosphorus acids also include phosphonic acids and phosphinic acids.

In one embodiment, the phosphorus materials can be one of the alkyl (or sometimes fatty alkyl) phosphates or phosphites, which are generally of the formula $(RO)_2PHO$. Dialkyl phosphite, as shown in the preceding formula, are often present with a minor amount of monoalkyl phosphite of the formula (RO)(HO)PHO, where R is typically an alkyl group. In certain embodiments, the phosphite will have sufficiently long hydrocarbyl groups to render the phosphite substantially oleophilic. In some embodiments the hydrocarbyl groups are substantially unbranched. Many suitable phosphites are available commercially and may be synthesized as described in U.S. Pat. No. 4,752,416. Certain phosphites contain 8 to 24 carbon atoms in each of R groups, such as 12 to 22 or 16 to 20 carbon atoms in each of the fatty radicals. In one embodiment the fatty phosphite can be formed from oleyl groups, thus having 18 carbon atoms in each fatty radical.

Other suitable phosphorus materials include amine salts of alkylphosphoric acids, such as include salts of oleyl and other long chain esters of phosphoric acid, with amines as elsewhere herein. Useful amines in this regard are tertiary-aliphatic primary amines, sold under the tradename Primene™. Others include dihydrocarbyl dithiophosphate esters, trihydrocarbylthiophosphates, or salts of any of the foregoing acidic phosphorus materials.

In one embodiment, eighty-five percent phosphoric acid is employed. In certain embodiments, multiple phosphorus compounds are present. Examples of such include combinations of dibutyl hydrogen phosphite and phosphoric acid.

The phosphorus-containing compound, in certain embodiments, will comprise a separate and distinct component from component (c), the nitrogen-containing dispersant. In certain embodiments, however, where the nitrogen-containing dispersant is reacted with an inorganic phosphorus compound, the phosphorus-containing dispersant may be counted as the phosphorus-containing compound (d). In other embodiments there will be an additional and separate phosphorus-containing compound (d) in addition to and distinct from any phosphorus-containing dispersant of (c).

The amount of the phosphorus-containing compound or compounds in the compositions of the present invention may, in certain embodiments, be 0.01 to 2 percent by weight, alternatively, 0.02 to 1 or 0.05 to 0.5 percent by weight. Correspondingly, the total phosphorus content of the compositions may be, for instance 0.01 to 0.3 percent by weight or 0.003 or 0.03 to 0.20 percent by weight or 0.05 to 0.15 percent by weight, depending, of course, on the phosphorus content of the particular compounds that are selected.

However, the composition of the present invention will contain no more than 0.1 percent by weight of a zinc dialkyldithiophosphate or, in some embodiments, more generally a zinc dihydrocarbyldithiophosphate (sometimes referred to as ZDP), that is, the zinc salt of a dialkyldithiophosphoric acid. Such materials may be represented by the formula

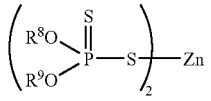

where $R^8$ and $R^9$ are independently hydrocarbyl groups such as alkyl, cycloalkyl, aralkyl or alkaryl groups having 3 to 20 carbon atoms, or 3 to 16 or 3 to 12 carbon atoms. They are typically prepared by the reaction of one or a mixture of alcohols $R^8OH$ and $R^9OH$, which can be a mixture of a secondary alcohol and a primary alcohol, for instance, isopropanol and 4-methyl-2-pentanol, with phosphorus pentasulfide to give the acid, followed by neutralization with zinc oxide. ZDPs are extremely well known in the lubricant industry, being very widely used to impart various properties to lubricants, including anti-wear, anti-scuffing, anti-corrosion and antioxidant properties. However, ZDPs may be undesirable because they may be hydrolytically or thermally unstable, leading to formation of decomposition products that can interfere with clutch plate operation and overall deterioration of performance with time. Moreover, it may be environmentally desirable to provide lubricants having reduced metal content, such as reduced Zn content. Accordingly, the present invention provides a lubricant composition which exhibits acceptable performance, even when they are free from ZDP or substantially free from ZDP. By "substantially free from ZDP" it is meant that the formulation is prepared without the intentional addition of any ZDP, or alternatively, only a very small amount of ZDP. For example, the formulations may contain less than 0.1 percent by weight ZDP or less, such as or 0.001 to 0.1 percent or 0.005 to 0.05 percent. In certain embodiments, the formulations are substantially free from zinc compounds of any type, thus containing, e.g., less than 0.05 percent by weight Zn or 0.0005 to 0.03 percent or 0.001 to 0.01 or 0.0001 to 0.005 percent or less of Zn.

When the composition is in the form of a concentrate, the relative amounts of the various components will be proportionately increased, for instance, by a factor such as 10 (except for the oil of lubricating viscosity, which will be correspondingly decreased). In that case, a correspondingly increased amount of ZDP, such as up to 1 percent or 0.5 or 0.3 or 0.1 percent may be acceptable in a concentrate.

Other components which are conventionally employed in a transmission fluid, in particular, and automatic transmission fluid (ATF) may typically be present in the present formulations.

One component frequently used is a viscosity modifier. Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers.

Examples of commercially available VMs, DVMs and their chemical types include the following: polyisobutylenes (such as Indopol™ from BP Amoco or Parapol™ from ExxonMobil); Olefin copolymers (such as Lubrizol™ 7060, 7065, and 7067 from Lubrizol and Trilene™ CP-40 and CP-60 from Uniroyal); hydrogenated styrene-diene copolymers (such as Shellvis™ 40 and 50, from Shell and LZ® 7341, 7351, and 7441 from Lubrizol); Styrene/maleate copolymers, which are dispersant copolymers (such as LZ® 3702, 3715, and 3703 from Lubrizol); polymethacrylates, some of which have dispersant properties (such as those in the Acryloid™ and Viscoplex™ series from RohMax, the TLA™ series from Texaco, and LZ® 7702 and LZ® 7720 from Lubrizol); olefin-graft-polymethacrylate polymers (such as Viscoplex™ 2-500 and 2-600 from Rohm GmbH); and hydrogenated polyisoprene star polymers (such as Shellvis™ 200 and 260, from Shell). Recent summaries of viscosity modifiers can be found in U.S. Pat. Nos. 5,157,088, 5,256,752 and 5,395,539. The VMs and/or DVMs are incorporated into the fully-formulated compositions at a level of up to 15% by weight. Suitable amounts include 1 to 12% or 3 to 10%.

Another component that may be used in the composition used in the present invention is a supplemental friction modifier. Friction modifiers are well known to those skilled in the art. A useful list of friction modifiers is included in U.S. Pat. No. 4,792,410. U.S. Pat. No. 5,110,488 discloses metal salts of fatty acids and especially zinc salts, useful as friction modifiers. A list of friction modifiers includes:

(a) borated fatty epoxides
(b) fatty epoxides
(c) borated alkoxylated fatty amines
(d) alkoxylated fatty amines
(e) fatty amines
(f) borated glycerol esters
(g) glycerol esters
(h) metal salts of fatty acids
(i) fatty acid amides
(j) fatty imidazolines
(k) condensation products of carboxylic acids and polyalkylene-polyamines
(l) sulfurized olefins
(m) metal salts of alkyl salicylates
and mixtures thereof.

Representatives of each of these types of friction modifiers are known and are commercially available. For instance, (a) borated fatty epoxides are known from Canadian Patent No. 1,188,704. These oil-soluble boron-containing compositions are prepared by reacting, at a temperature from 80° C. to 250° C., boric acid or boron trioxide with at least one fatty epoxide having the formula

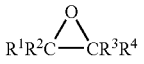

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide preferably contains at least 8 carbon atoms.

The borated fatty epoxides can be characterized by the method for their preparation which involves the reaction of two materials. The first of these, Reagent A can be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° to 250° C., preferably 100° to 200° C., for a period of time sufficient for reaction to take place. If desired, the reaction may be effected in the presence of a substantially inert, normally liquid organic diluent. During the reaction, water is evolved and may be removed by distillation.

(b) Non-borated fatty epoxides, corresponding to "Reagent B" above, are also useful as friction modifiers.

Borated amines are generally known from U.S. Pat. No. 4,622,158. Borated amine friction modifiers (including (c) borated alkoxylated fatty amines) are conveniently prepared by the reaction of a boron compounds, as described above, with the corresponding amines. The amine can be a simple fatty amine or hydroxy containing tertiary amines. The borated amines can be prepared by adding the boron reactant, as described above, to an amine reactant and heating the resulting mixture at a 50° to 300° C., preferably 100° C. to 250° C. or 150° C. to 230° C., with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10]cocoamine); ETHOMEEN™ S/12 (bis[2-hydroxyethyl]soyamine); ETHOMEEN™ T/12 (bis[2-hydroxyethyl]-tallow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl]octadecylamine); and ETHOMEEN™ 18/25 (polyoxyethyl-ene[15] octadecylamine). Fatty amines and ethoxylated fatty amines are also described in U.S. Pat. No. 4,741,848.

The (d) alkoxylated fatty amines, and (e) fatty amines themselves (such as oleylamine) are generally useful as friction modifiers in this invention. Such amines are commercially available.

Both borated and unborated fatty acid esters of glycerol can be used as friction modifiers. The (f) borated fatty acid esters of glycerol are prepared by borating a fatty acid ester of glycerol with boric acid with removal of the water of reaction. Preferably, there is sufficient boron present such that each boron will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, or oil.

(g) Fatty acid esters of glycerol themselves can be prepared by a variety of methods well known in the art. Many of these esters, such as glycerol monooleate and glycerol tallowate, are manufactured on a commercial scale. The esters useful are oil-soluble and are preferably prepared from C8 to C22 fatty acids or mixtures thereof such as are found in natural products and as are described in greater detail below. Fatty acid monoesters of glycerol are preferred, although, mixtures of mono- and diesters may be used. For example, commercial glycerol monooleate may contain a mixture of 45% to 55% by weight monoester and 55% to 45% diester.

Fatty acids can be used in preparing the above glycerol esters; they can also be used in preparing their (h) metal salts, (i) amides, and (j) imidazolines, any of which can also be used as friction modifiers. Preferred fatty acids are those containing 6 to 24 carbon atoms, preferably 8 to 18. The acids can be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. A particularly preferred acid is oleic acid. Preferred metal salts include zinc and calcium salts. Examples are overbased calcium salts and basic oleic acid-zinc salt complexes which can be represented by the general formula $Zn_4Oleate_3O_1$. Preferred amides are those prepared by condensation with ammonia or with primary or secondary amines such as diethylamine and diethanolamine. Fatty imidazolines are the cyclic condensation product of an acid with a diamine or polyamine such as a polyethylenepolyamine. The imidazolines are generally represented by the structure

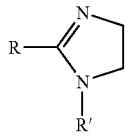

where R is an alkyl group and R' is hydrogen or a hydrocarbyl group or a substituted hydrocarbyl group, which may include —$(CH_2CH_2NH)_n$— as a part thereof. In a preferred embodiment the friction modifier is the condensation product of a C8 to C24 fatty acid with a polyalkylene polyamine, and in particular, the product of isostearic acid with tetraethylenepentamine. The condensation products of carboxylic acids and polyalkyleneamines (k) may generally be imidazolines or amides.

Sulfurized olefins (l) are well known commercial materials used as friction modifiers. A particularly preferred sulfurized olefin is one which is prepared in accordance with the detailed teachings of U.S. Pat. Nos. 4,957,651 and 4,959,168. Described therein is a cosulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol.

Reactant (3), the olefin component, comprises at least one olefin. This olefin is preferably an aliphatic olefin, which usually will contain 4 to 40 carbon atoms, preferably from 8 to 36 carbon atoms. Terminal olefins, or alphaolefins, are preferred, especially those having from 12 to 20 carbon atoms. Mixtures of these olefins are commercially available, and such mixtures are contemplated for use in this invention.

The cosulfurized mixture of two or more of the reactants is prepared by reacting the mixture of appropriate reactants with a source of sulfur. The mixture to be sulfurized can contain 10 to 90 parts of Reactant (1), or 0.1 to 15 parts by weight of Reactant (2); or 10 to 90 parts, often 15 to 60 parts, more often 25 to 35 parts by weight of Reactant (3), or 10 to 90 parts by weight of reactant (4). The mixture, in the present invention, includes Reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process of the present invention include elemental sulfur, which is preferred, hydrogen sulfide, sulfur halide plus sodium sulfide, and a mixture of hydrogen sulfide and sulfur or sulfur dioxide. Typically often 0.5 to 3 moles of sulfur are employed per mole of olefinic bonds.

Metal salts of alkyl salicylates (m) include calcium and other salts of long chain (e.g. C12 to C16) alkyl-substituted salicylic acids.

The supplemental friction modifier can be used in addition to component (b). The amount of the supplemental friction modifier, if present, may be generally 0.1 to 1.5 percent by weight of the lubricating composition, preferably 0.2 to 1.0 or 0.25 to 0.75 percent. In some embodiments, however, the amount of the supplemental friction modifier is present at less than 0.2 percent or less than 0.1 percent by weight, for example, 0.01 to 0.1 percent.

The compositions of the present invention can also include a detergent. Detergents as used herein are metal salts of organic acids. The organic acid portion of the detergent is a sulfonate, carboxylate, phenate, salicylate. The metal portion of the detergent is an alkali or alkaline earth metal. Suitable metals include sodium, calcium, potassium and magnesium. Typically, the detergents are overbased, meaning that there is a stoichiometric excess of metal base over that needed to form the neutral metal salt.

Suitable overbased organic salts include the sulfonate salts having a substantially oleophilic character and which are formed from organic materials. Organic sulfonates are well known materials in the lubricant and detergent arts. The sulfonate compound may contain on average 10 to 40 carbon atoms, for instance, 12 to 36 carbon atoms or 14 to 32 carbon atoms on average. Similarly, the phenates, salicylates, and carboxylates have a substantially oleophilic character.

While the present invention allows for the carbon atoms to be either aromatic or in paraffinic configuration, typically alkylated aromatics be employed. While naphthalene based materials may be employed, although typically the benzene moiety is used.

In certain embodiments the detergent is an overbased monosulfonated alkylated benzene, such as the monoalkylated benzene. Typically, alkyl benzene fractions are obtained from still bottom sources and are mono- or di-alkylated. It is believed, in the present invention, that the mono-alkylated aromatics are particularly suitable.

It is desired that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of mono-functional (e.g., mono-sulfonated) materials avoids crosslinking of the molecules with less precipitation of the salt from the lubricant.

In certain embodiments the salt is "overbased." By overbasing, it is meant that a stoichiometric excess of the metal base be present over that required to neutralize the anion of the salt. The excess metal from overbasing has the effect of neutralizing acids which may build up in the lubricant. A second advantage is that the overbased salt increases the dynamic coefficient of friction. Typically, the excess metal base will be present over that which is required to neutralize the anion at in the ratio of up to 30:1, such as 5:1 to 18:1, on an equivalent basis.

The amount of the overbased salt utilized in the composition is typically 0.025 to 3 weight percent on an oil free basis, such as 0.1 to 1.0 percent. However, when a low ash (low metal-containing) composition is desired, the overbased salt may be present at lower amounts, such as 0.01 to 0.1 percent or less, or it can be omitted (substantially absent). The overbased salt is usually made up in about 50% oil with a TBN range of 10-600 on an oil free basis. Borated and non-borated overbased detergents are suitable, as described in U.S. Pat. Nos. 5,403,501 and 4,792,410.

Other materials can optionally be included in the compositions of the present invention, provided that they are not incompatible with the aforementioned required components or specifications. Such materials include antioxidants (that is, oxidation inhibitors), including hindered phenolic antioxidants, hindered phenolic ester antioxidants, secondary aromatic amine antioxidants, sulfurized phenolic antioxidants, oil-soluble copper compounds, phosphorus-containing antioxidants, organic sulfides, disulfides, and polysulfides. Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or /maleate copolymers, and styrene/maleate copolymers. Also known are anti-foam agents. These optional materials are known to those skilled in the art, are generally commercially available, and are described in greater detail in published European Patent Application 761,805. Also included can be known materials such as corrosion inhibitors, dyes, fluidizing agents, odor masking agents, and antifoam agents. Organic borate esters and organic borate salts can also be included.

The above components can be in the form of a fully-formulated lubricant or in the form of a concentrate within a smaller amount of lubricating oil. If they are present in a concentrate, their concentrations will generally be directly proportional to their concentrations in the more dilute form in the final blend.

EXAMPLES 1 AND 2

Synthesis of the Condensate of an Amine with Glycolic Acid

Example 1. Armeen™ 2C, dicocoamine, from Akzo, 468.2 g (1.2 equivalents) is added to a 1 L 4-neck flask, equipped with a mechanical stirrer, nitrogen inlet, thermocouple, and Dean-Stark trap with a condenser. The flask and its contents are heated to 80° C. with stirring. To the flask is added 130.4 g glycolic acid 70% in water, from TCI (1.2 equivalents), via an addition funnel over 20 minutes. The reaction mixture is heated to 180° C. over a 2 hour period while collecting distillate. The mixture is held at 180° C. for an additional 5½ hours, then cooled overnight. Thereafter, the mixture is heated to 70° C. and 20 g filter aid is added. The mixture is stirred for 15 minutes and filtered through a cloth pad. The reaction product is a clear light-amber liquid filtrate, 503.6 g, having an analysis of 3.15% N, TBN 9.57, TAN 1.75.

Example 2. The procedure of Example 1 is substantially repeated, except that the amine used is the corresponding amount of Armeen™ HTL8 (a (2-ethylhexyl)(hydrogenated tallow) amine).

EXAMPLES 3 AND 4 AND REFERENCE EXAMPLE 1

Lubricant Formulations

Three formulations containing components typical of automatic transmission fluids are prepared. Each formulation was prepared in a blend of high viscosity-index synthetic base oils (60.2% of 4 $mm^2s^{-1}$ (cSt) and 25.8% of 2 $mm^2s^{-1}$ (cSt) at 100° C. oils, total base oil 86%). In addition to a friction modifier identified in the table below, each formulation contains 5.0% succinimide-containing dispersants (including about 42% oil), 4.0% functionalized polymethacrylate dispersant-viscosity modifier (including 26% oil), 0.04% thiadiazole inhibitor, 1.1% aromatic amine and substituted hydrocarbyl sulfide antioxidants, 0.4% heterocyclic sulfur-containing seal swell agent, 0.2% borate ester friction modifier, 0.07% overbased calcium sulfonate detergent (including 50% oil), 0.2% methacrylate copolymer viscosity modifier, (including 40% oil), 0.11% dibutyl hydrogen phosphite, 0.18% additional diluent oil, 0.1% 85% phosphoric acid, 0.02% red dye, and 0.03% commercial antifoam agent.

| | Ex. 3 Condensate as in Ex. 1: 2.5% | Ex. 4 Condensate as in Ex. 2: 2.5% | Ref. Example 1 Condensate of isostearic acid + tri(hydroxymethyl) aminomethane: 2.5% |
|---|---|---|---|
| Test Results: | | | |
| % Vis. Change 40° C. | 4.54% | 4.27% | 719% |
| % Vis Change 100° C. | 2.46% | 40.0% | 422% |
| Delta TAN, ASTM D 664 (mg KOH) | 1.09 | 0.67 | 9.2 |
| Cu corrosion test | | | |
| wt. change, mg | −27.1 | −10.1 | −109.1 |
| rating ASTM D130 | 3A | 3B | 4B |
| ppm Cu | 214 | 33 | 1117 |

The viscosity change test is an ISOT (Indiana stirrer oxidation test) in which the oil is thermally oxidized and stressed in the presence of iron and copper coupons. The conditions for this test is 170° C. heating for 168 hours. The Total Base Number, Total Acid Number, and viscosity are measured for samples before and after the test. The results show that the compositions of the present invention exhibit very good viscosity stability, with 40% or less viscosity increase, and typically less than 5% increase. (It is noted that in a separate "ATF spot screen test," in which 200 ppm Cu and 250 ppm Fe as the naphthenates are added to hasten oxidation and the samples are blown with air for 240 hours at 157° C., the material of Ref. Example 1 gives an increase of 100° C. viscosity of 2.9% while that of Ex. 3 is 20.8% and that of Ex 4. is 40.1%. It is believed that the ISOT test is generally a more reliable indicator of oxidative stability than is the spot screen test.)

The formulations of the present invention also exhibit very good (very small) change in Total Acid Number (TAN) as measured by ASTM D 664.

The copper corrosion tests are conducted by the "ZF copper corrosion test" procedure, in which a weighed copper coupon is placed in the test oil, heated to 150° C. for 168 hours with 83 mL/min air purge. At the end of the test, copper weight loss from the coupon, % copper in the test drain, and visual rating (ASTM D-130) are reported. The samples at the end of the test exhibit little weight loss and receive a good visual rating, and the fluid at the end of the test contains a relatively low concentration of copper.

Fluid formulations prepared corresponding to Examples 3 and 4 and Ref. Ex. 1 are also tested to determine the static friction in terms of μT or the stabilized static friction coefficient from the SAE#2 test procedure and Japanese Automobile Standard, JASO M-348-95, "Test method for friction property of automatic transmission fluids." The μT represents a measure of the holding capacity of clutches lubricated with the test fluid. Holding capacity is an important requirement as the weight and cost of transmission are optimized. Values of μT of at least 0.12 or at least 0.15 are desirable, e.g., 0.15 or even 0.16 or 0.17 to 0.19. Results are shown in the following Table for 5 through 5000 test cycles:

| | μT | | |
|---|---|---|---|
| cycles | Ex 3 | Ex 4 | Ref Ex 1 |
| 5 | 0.160 | 0.170 | 0.132 |
| 10 | 0.171 | 0.168 | 0.136 |
| 20 | 0.172 | 0.162 | 0.141 |
| 50 | 0.175 | 0.172 | 0.149 |
| 100 | 0.174 | 0.175 | 0.154 |
| 200 | 0.176 | 0.175 | 0.155 |
| 500 | 0.175 | 0.173 | 0.155 |
| 1000 | 0.172 | 0.174 | 0.158 |
| 2000 | 0.171 | 0.175 | 0.159 |
| 3000 | 0.170 | 0.169 | 0.158 |
| 4000 | 0.168 | 0.170 | 0.156 |
| 5000 | 0.164 | 0.169 | 0.155 |

The formulations of the present invention are well able to provide a very good, high static friction, while having the added benefits of low copper corrosion and improved oxidation resistance.

EXAMPLE 5 THROUGH 9

Lubricant Formulations

Lubricant formulations are prepared as described in the following Table. Each of the variations in composition (presence or absence of the stated components as well as their amounts and chemical nature, e.g., of the oil, dispersant, viscosity modifier, corrosion inhibitor, antiwear agent, pour point depressant, supplemental phosphorus acid, antioxidant) should be understood to be independently and generally applicable as contemplated variations throughout the scope of the invention.

| | Example 5 | Example 6 | Example 7 | Example 8 | Example 9 |
|---|---|---|---|---|---|
| Base Oil | blend of high vis. index (VI) synthetic base oils (60.2% of 4 $mm^2/s$ + 25.8% of 2 $mm^2/s$, all at 100° C.) | blend of high VI synthetic base oils as in Ex. 5 | blend of high VI synthetic base oils as in Ex. 5 | blend of high VI synthetics (60.2% of 4 $mm^2/s$ + 25.8% of 2 $mm^2/s$) from GTL[a] process | 4 $mm^2/s$ poly-alpha olefin base stock. |
| Dispersant | 5.0% succinimide-cont'g. dispersants (incl. about 42% oil) | 5.0% boron and phosphorus cont'g. succinimide dispersant[b] | 5.0% B cont'g. dispersant made by direct alkylation process[c] | 5.0% B and terephthalic acid cont'g. dispersant | 4.0% succinimide dispt + 1.0% DMTD[d] treated ester-amide dispersant |
| Viscosity Modifier (VM) | 4.0% functionalized polymethacrylate dispersant-VM (incl. 26% oil) | 5.0% styrene ester polymer VM | 4.0% VM as in Ex. 5 | 4.0% VM as in Ex. 5 | 4.0% VM as in Ex. 5 |
| Corrosion Inhibitor | 0.04% thiadiazole or triazole | 0.025% tolyltriazole | 0.5% dialkyl-2,5-dimercapto thiadiazole | 0.025% tolyltriazole | 0.05% dialkyl-2,5-dimercapto thiadiazole |
| Antioxidants (AO) | 1.1% aromatic amine and substituted | 1.1% aromatic amine and butylated | 1.1% aromatic amine and substituted | 1.1% aromatic amine and substituted | 1.1% mixed aromatic amine, hydrocarbyl |

-continued

| | Example 5 | Example 6 | Example 7 | Example 8 | Example 9 |
|---|---|---|---|---|---|
| | hydrocarbyl sulfide AOs | phenol AOs | hydrocarbyl sulfide AOs | hydrocarbyl sulfide AOs | sulfide, & butylated phenol AOs |
| Seal Swell Agents | 0.4% heterocyclic S-contg seal swell agent | | | 1.5% heterocyclic S-contg seal swell agent | |
| Friction Modifier | 0.2% borate ester | | 0.2% borate ester | | |
| Detergent | 0.07% over based Ca sulfonate detergent (incl. 50% oil) | 0.07% detergent as in Ex. 5 | 0.07% detergent as in Ex. 5 | 1.3% detergent as in Ex. 5 | 0.05% Calcium phenate detergent |
| Pour Point Depressant | 0.2% methacrylate copolymer (incl. 40% oil) | 0.2% methacrylate copolymer (incl. 40% oil) | | | |
| Anti-wear Agent | 0.11% dibutyl hydrogen phosphite | 0.2% diphenyl phosphite | 0.2% dibutyl hydrogen phosphite | 0.5% triphenyl thiophosphate | 0.25% triphenyl phosphite |
| Additional Diluent Oil | 0.18% | 2.0% | 0.18% | 2.0% | 0.18% |
| Phosphorus acid | 0.085% phosphoric acid | 0.085% phosphorous acid | 0.12% phosphoric acid | | |
| Dye | 0.02% red | 0.02% red | 0.02% red | 0.02% red | 0.02% red |
| Foam Inhibitor | 0.03% commercial silicone | 0.03% commercial silicone | 0.03% commercial silicone | 0.03% commercial silicone | 0.03% commercial silicone |
| Friction Modifier[e] | 2.5% | 2.5% | 2.5% | 2.5% | 2.5% |

[a]Gas-to-liquid, or Fischer-Tropsch process
[b]As disclosed in, e.g., U.S. Pat. No. 4,857,214
[c]As disclosed in, e.g., U.S. Pat. No. 6,077,909
[d]Dimercaptothiadiazole
[e]Each of condensates of Examples 1 or 2, as separate examples or mixed Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method of lubricating a transmission comprising supplying thereto a composition which comprises:

(a) a major amount of oil of lubricating viscosity;

(b) an amide or thioamide represented by the formula $$R^1R^2N—C(X)R^3$$

wherein X is O or S, $R^1$ and $R^2$ are each independently hydrocarbyl groups of at least 6 carbon atoms, and $R^3$ is a hydroxyalkyl group of 1 to 6 carbon atoms or a group formed by the condensation of said hydroxyalkyl group, through a hydroxyl group thereof, with an acylating agent;

(c) a nitrogen-containing dispersant; and (d) a phosphorus-containing compound, provided that the composition contains less than 0.1 percent by weight of a zinc dialkyldithiophosphate.

2. The method of claim 1 wherein $R^1$ and $R^2$ are each independently alkyl groups of about 8 to about 24 carbon atoms.

3. The method of claim 1 wherein X is O and wherein the amine moiety $R^1R^2N$— of the amide or thioamide comprises a di-cocoalkyl amine moiety.

4. The method of claim 1 wherein X is O and wherein the amine moiety $R^1R^2N$— of the amide or thioamide comprises a (2-ethylhexyl)(hydrogenated tallow) amine moiety.

5. The method of claim 1 wherein the moiety —$C(X)R^3$ of the amide comprises a glycolic moiety.

6. The method of claim 1 wherein the amount of the amide or thioamide of (b) is about 0.05 to about 10 percent by weight.

7. The method of claim 1 wherein the dispersant (c) comprises a boron-containing succinimide dispersant.

8. The method of claim 1 wherein the amount of the dispersant or dispersants is about 0.1 to about 10 percent by weight.

9. The method of claim 1 wherein the phosphorus-containing compound comprises phosphoric acid, phosphorous acid, a phosphonic acid, or esters of any such acids; a dihydrocarbyl hydrogen phosphite; a dihydrocarbyl dithiophosphate ester; a trihydrocarbylthiophosphate; or a salt of any of such materials.

10. The method of claim 1 wherein a plurality of phosphorus-containing compounds is present, comprising dibutyl hydrogen phosphite and phosphoric acid.

11. The method of claim 1 wherein the total phosphorus content of the composition is about 0.01 to about 0.30 percent by weight.

12. The method of claim 1 further comprising at least one additive selected from the group consisting of detergents, antioxidants, corrosion inhibitors, seal swell agents, anti-wear agents, anti-foam agents, viscosity modifiers, and friction modifiers in an amount of at least 0.2% by weight.

13. The method of claim 1 further comprising at least one additive selected from the group consisting of organic borate esters and organic borate salts.

14. The method of claim 1 wherein the composition is prepared by mixing the components recited in claim 1.

15. The method of claim 1 wherein the transmission is an automatic transmission.

* * * * *